US005507343A

United States Patent [19]

Carlton et al.

[11] Patent Number: 5,507,343

[45] Date of Patent: Apr. 16, 1996

[54] APPARATUS FOR REPAIRING DAMAGED WELL CASING

[75] Inventors: Wayne Carlton, Dallas; Enrique Chavira, Mineral Wells; O. M. Bell, Fort Worth, all of Tex.

[73] Assignee: Texas BCC, Inc., Dallas, Tex.

[21] Appl. No.: 318,211

[22] Filed: Oct. 5, 1994

[51] Int. Cl.[6] ..... E21B 33/124; E21B 33/13; E21B 33/16

[52] U.S. Cl. ..... 166/277; 166/114; 166/127; 166/146; 166/147; 166/191

[58] Field of Search ..... 166/114, 127, 166/129, 146, 147, 191, 277

[56] References Cited

U.S. PATENT DOCUMENTS

| | | | |
|---|---|---|---|
| 886,114 | 4/1908 | Collingwood | 166/191 |
| 2,500,601 | 3/1950 | Butler, Jr. . | |
| 2,638,987 | 5/1953 | Condra | 166/191 |
| 3,618,639 | 11/1971 | Daley et al. | 138/197 |
| 3,659,648 | 5/1972 | Cobbs | 166/191 X |
| 3,797,572 | 3/1974 | Mignotte | 166/127 |
| 3,842,912 | 10/1974 | Lindsey | 166/191 X |
| 3,861,465 | 1/1975 | Mignotte | 166/127 X |
| 4,125,159 | 11/1978 | Vann | 166/285 |
| 5,027,895 | 7/1991 | Barton | 166/191 |
| 5,058,673 | 10/1991 | Muller et al. | 166/191 X |
| 5,079,837 | 1/1992 | Vanselow | 138/97 |
| 5,297,633 | 3/1994 | Snider et al. | 166/122 X |
| 5,404,944 | 4/1995 | Lynde et al. | 166/237 X |

*Primary Examiner*—Roger J. Schoeppel
*Attorney, Agent, or Firm*—Smith & Catlett

[57] ABSTRACT

A method and apparatus for repairing or isolating holes, ruptures, splits or old perforations in marginal oil and gas wells from producing perforations. The apparatus includes two packer assemblies, a tube assembly and a slip assembly. The packer assemblies further include expandable packer elements and a vent cone mounted on a mandrel. The mandrels of the packer assemblies are connected to opposite ends of the tube assembly. The slip assembly is housed on the mandrel of one packer assembly and is used to create a positive mechanical set of the repair apparatus when positioned over the damaged area. Once the packer apparatus is positioned and the packer elements expanded, gas from producing formations flow to the wellhead through the tube assembly without interfering with the operation of downhole pumps. The length of the gas vent packer apparatus can be varied between the packer elements depending upon the depth of damaged casing requiring repair or isolation.

12 Claims, 1 Drawing Sheet

APPARATUS FOR REPAIRING DAMAGED WELL CASING

BACKGROUND OF THE INVENTION

1. Field of the Invention

This invention relates to oil and gas well-repair equipment, and more particularly, to a method and apparatus for quickly and inexpensively repairing damaged casing of producing oil wells.

2. Description of Related Art

A primary concern in the oil and gas industry is to how to inexpensively repair damaged casing in marginal producing wells. During the production life of a well, corrosion may cause splits, holes or ruptures to form in the well's casing. When undesired fluids, such as water, enter the casing bore through old perforations or damaged casing, the free flow of oil or gas is inhibited or prevented.

For example, in a standard oil and gas well, production tubing is inserted in the casing bore to channel and collect oil and gas from producing perforations. If the casing becomes damaged, undesired fluids may collect between the casing wall and production tubing or within the bore of the production tubing. Accumulation of undesired fluids in either the casing-tubing annulus or production tubing bore creates a hydrostatic pressure sufficient to prevent the free flow of formation fluids into the production tubing.

Traditional methods of isolating old perforations or repairing damaged casing include the use of squeeze cementing and casing patches. Squeeze cementing is a method whereby cement is pumped through the damaged casing at a pressure sufficient to squeeze the water from the cement and leave a cement sheath between the geological formation and the outer surface of the casing. Use of this method, however, causes excess cement to remain inside the casing bore. This excess amount must then be drilled out before the well can be returned to producing status.

The squeeze cement method is inefficient and cost prohibitive for the interested party when faced with the need to repair a marginal producing oil or gas well. A marginal well produces under ten barrels oil equivalent per day and nets approximately $2,000 per month to the party with the working interest. Depending upon the depth of the damaged casing, the cost of a single cement squeeze repair ranges from $35,000 to $50,000. Therefore, it may take approximately seventeen to twenty-five months before a marginal well produces amounts sufficient to recoup repair expenses and enable the interested party to receive a payout.

Alternative repair methods include the use of casing patches. Standard casing patches use packer elements or swab rubbers to straddle the damaged interval of casing. Such methods and apparatus have proven unsatisfactory, however, because these patches may decrease the internal diameter of the well casing, restrict access to the bottom of the well, may not be mechanically set, nor allow for the separate venting of gas through the packer elements.

The present method and apparatus for repairing damaged well casing is cost prohibitive in marginal wells. Therefore, there exists a need for an improved method and apparatus for the repair of oil and gas well casing which enables the interested party to cost effectively and efficiently repair marginally producing wells.

SUMMARY OF THE INVENTION

According to the present invention, a method and apparatus are provided for reliable, cost efficient repair of damaged pipe such as the casing of an oil and gas well.

According to a preferred embodiment of the invention, a method is provided for repairing damaged casing of an oil and gas-well comprising the steps of determining the location of the damaged casing, assembling a gas vent packer apparatus, connecting the gas vent packer apparatus to a first and second length of production tubing, inserting said production tubing and gas vent packer apparatus inside said well casing, positioning said gas vent packer apparatus over the damaged casing, and setting said gas vent packer apparatus.

According to another embodiment of the invention, a method for repairing damaged casing is provided further comprising the step of venting gas through the gas vent packer apparatus. According to another embodiment of the invention, a method for repairing damaged casing is provided further comprising the step of retrieving the gas vent packer after production from the well has reached its economic limit.

According to another embodiment of the invention, a gas vent packer apparatus is provided, comprising a first packer assembly having a mandrel, a cone and a packer element, a second packer assembly having a mandrel, a cone and a packer element, a tube assembly, and a slip assembly. In this embodiment, the tube assembly is connected between the first and second packer assemblies and the slip assembly is mounted on the mandrel of the second packer assembly.

According to another embodiment of the invention, a gas vent packer apparatus is provided wherein the first and second packer assemblies have a plurality of packer elements. According to another embodiment of the invention, a gas vent packer apparatus is provided wherein the slip assembly has a plurality of retractable slips.

According to another embodiment of the invention, a gas vent packer apparatus is provided where the tube assembly comprises a first and second tube, wherein the second tube is positioned inside the first tube forming an annulus between the tubes. According to another embodiment of the invention, the annulus is a gas vent.

According to another embodiment of the invention, a gas vent packer apparatus is provided wherein the cone on the packer assemblies are vent cones. According to another embodiment of the invention, the vent cones further comprise a plurality of vent ports. According to another embodiment of the invention, the cone of the second packer assembly apparatus helps secure the retractable slips against a surface such as a well's casing when the gas vent apparatus is mechanically set into position.

According to another embodiment of the invention, a system for repairing damaged casing in an oil and gas well is provided, comprising, a first and second gas vent packer assembly, a slip assembly, and a means for venting gas to the surface of the well.

Specifically, in a preferred embodiment, the method and apparatus of the invention comprise a retrievable mechanical set casing patch comprising two packer assemblies and a slip assembly set on production tubing. The method and apparatus of the invention creates an inexpensive procedure to repair casing leaks in marginal wells that the interested party cannot afford to squeeze cement and drill-out due to the present economic climate for the oil and gas industry. In addition, the invention enables the interested party to repair or isolate damaged sections of casing and still provide an annulus between the tubing and casing for gas venting. Furthermore, the features of the invention do not limit the interested party from being able to hot oil, chemical treat or soap the formations via the casing.

Other objects and advantages of the present invention will be apparent to those of ordinary skill in the art having reference to the following specification together with the drawings.

BRIEF DESCRIPTION OF THE DRAWINGS

The novel features believed characteristic of the invention are set forth in the appended claims. The invention itself, however, as well as a preferred method and apparatus, and further objects and advantages thereof, will best be understood by reference to the following detailed description of an illustrative embodiment when read in conjunction with the following figures of the accompanying drawings, wherein:

DETAILED DESCRIPTION OF A PREFERRED EMBODIMENT

Figure 1A:
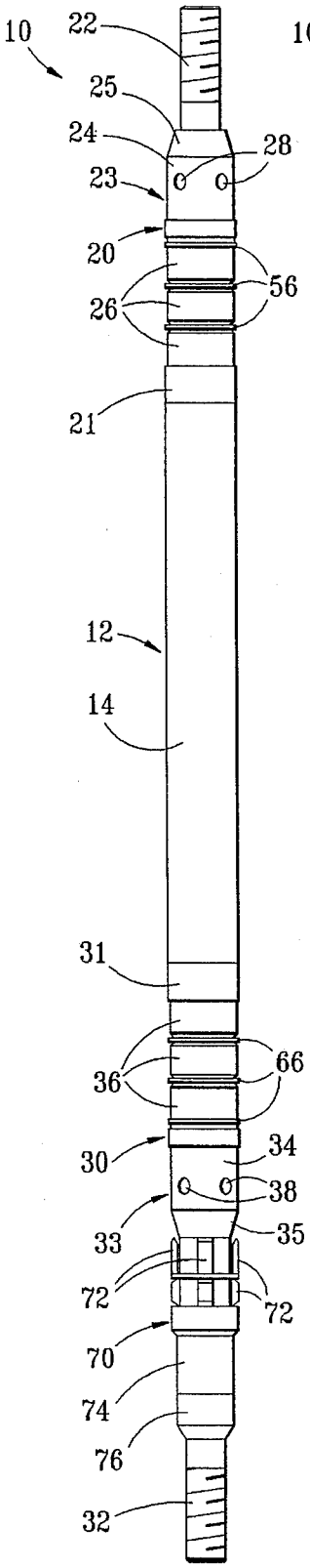
FIG. 1A is a perspective view of the gas vent packer apparatus of the invention.
Figure 1B:
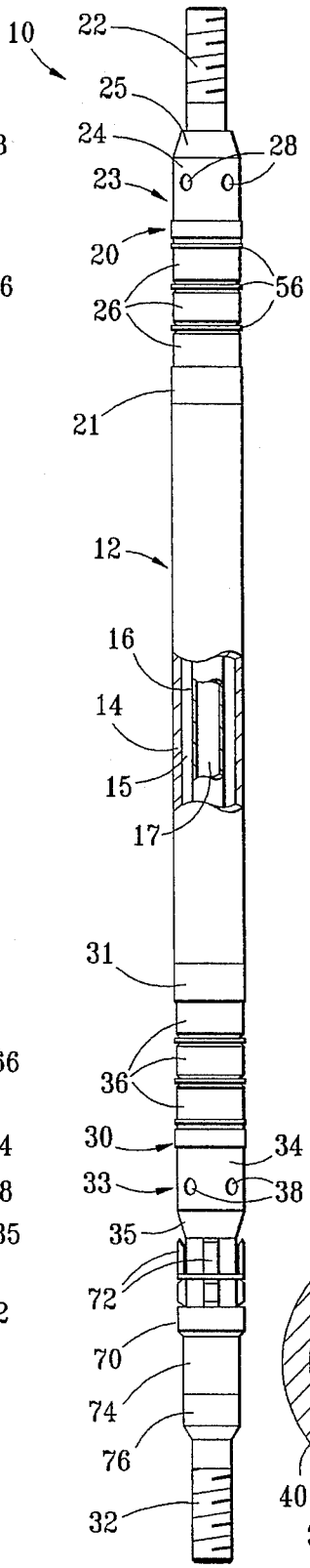
FIG. 1B is a perspective view of the gas vent packer apparatus of FIG. 1A with a sectional cutaway depicting the internal tube and annulus of the apparatus.
Figure 2:
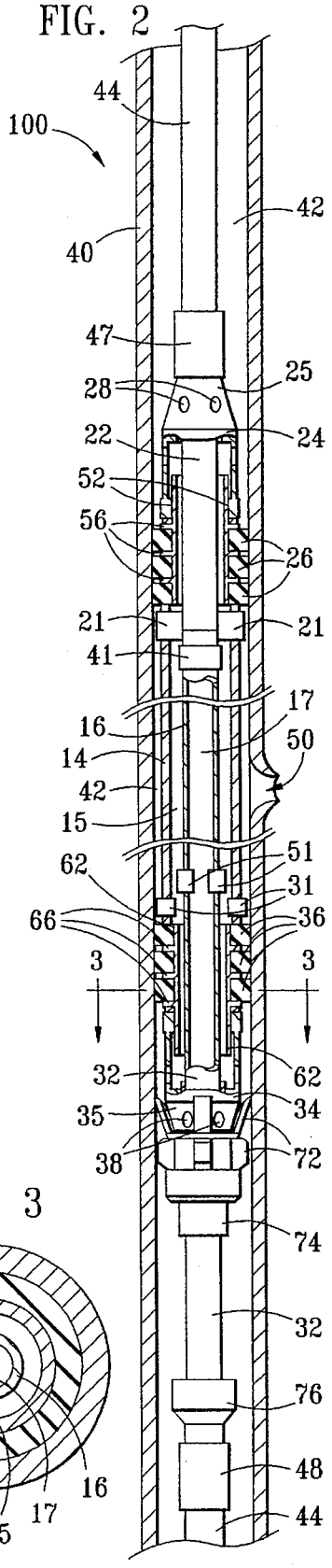
FIG. 2 is a plan view, partially in section, depicting the structure and relative placement of the apparatus preferred for use in the method of the invention.

As shown in FIGS. 1A and 1B, gas vent packer apparatus 10, preferably comprises first packer assembly 20 and second packer assembly 30 mounted on tubing assembly 12 and slip assembly 70. First and second packer assemblies 20, 30 preferably further comprise mandrels 22, 32, cones 23, 33 and packer elements 26, 36. Referring briefly to FIG. 2, packer assemblies 20, 30 comprise a plurality of expandable packer elements 26, 36, mounted on mandrels 22, 32 as shown, with packer sleeves 52, 62 and packer element spacers 56, 66. It will be understood and appreciated by one skilled in the art that different types of packer assemblies 20, 30 may be substituted for the design shown in FIGS. 1 and 2.

Referring back to FIGS. 1A and 1B, slip assembly 70 comprises a plurality of slips 72, housing 74 and support 76, and is preferably mounted on mandrel 32 of packer assembly 30. It will be understood by one skilled in the art that different types and numbers of slips may be substituted for slip elements 72 as shown in FIGS. 1A and 1B. Specifically, slips 72 can be any one or a plurality of retractable slips such as the rocker-type slips shown. Slips 72 are shown in FIG. 1A in the retracted, unengaged state, positioned just below the tapered end 35 of cone 33. As shown in FIGS. 1A and 1B, cones 23, 33 are preferably vent cones which contain a plurality of vent holes or gas ports 28, 38 in non-tapered sections 24, 34 of cones 23, 33, respectively.

Tubing assembly 12 preferably comprises external tube 14, and internal tube 16. Tube 16 is suspended inside the bore of tube 14, thereby defining annulus 15 between the outer surface of tube 16 and inner surface of tube 14. As shown in FIG. 2, packer assembly mandrels 22, 32 are attached to opposite ends of tube 16 with connecting devices 41, 51 thereby centering tube 16 within tube 14. Similarly, the opposite ends of external tube 14 are connected to packer assemblies 20, 30 with use of connecting devices 21, 31 as shown. It will be understood by one skilled in the art that connecting devices 21, 31, 41, and 51 can be any type of pipe fitting or connector such as standard or custom-designed threaded changeovers.

Specifically, internal tube 16 is suspended within the bore of tube 14 as follows. The upper end of internal tube 16 is connected to mandrel 22 of upper packer assembly 20 with threaded pipe changeover 41 and the lower end of internal tube 16 is connected to mandrel 32 of lower packer assembly 30 with threaded pipe changeover 51. External tube 14 is likewise attached to packer assemblies 20, 30 as follows. The upper end of external tube 14 is connected to upper packer assembly 20 with changeover 21 and the lower end of external tube 14 is connected to packer assembly 30 with changeover 31.

Attachment of tubing assembly 12 to packer assemblies 20, 30 lengthens annulus 15 beyond change overs 21, 31, 41, 51 to include the space between mandrels 22, 32 and packer sleeves 52, 62, creating a channel for the free flow of production gases through packer apparatus 10.

Figure 3:
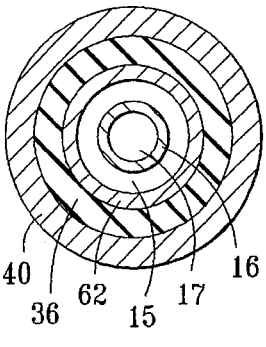
FIG. 3 is a cross-sectional view of the apparatus as shown in FIG. 2 taken along line 3—3.

Operation of the apparatus of the invention is best understood by describing the method of the invention with reference to FIGS. 2 and 3. Initially, the location and type of damage to the casing should be determined so that the appropriate dimensions of the gas vent packer apparatus and lengths of replacement production tubing may be chosen. For example, FIG. 2, depicts a hole or rupture 50 in casing 40 of oil and gas well section 100 at an unmarked depth. If not repaired, rupture 50 would allow free flow of undesired fluids into the casing bore 42 and the original production tubing (not shown) thereby inhibiting or preventing the free flow of production fluids into the wellhead.

In the method of the invention, the original production tubing is removed from the well, and the depth and extent of damage to the casing is determined. From these measurements, the proper length and size of the gas vent packer apparatus and replacement production tubing is calculated and assembled. Specifically, connecting devices 21, 31, 41, 51 are used to attach a predetermined length of tubing assembly 12 to packer assemblies 20, 30.

The length of tubing assembly 12 is determined by the size and depth of rupture 50. Specifically, tubing assembly 12 must be of sufficient length to facilitate proper placement of packer assemblies 20, 30 above and below the damaged casing interval. After slip assembly 70 is mounted on mandrel 32 of packer assembly 30, gas vent packer apparatus 10 is connected between first and second site specific lengths of production tubing 44, 46 and lowered into the casing bore 42 so that upper packer 20 and lower packer 30 straddle the damaged section. Finally, slips 72 of slip assembly 70 are engaged and the gas vent packer apparatus is mechanically set by rotation of the production tubing and apparatus. This causes a downward force on packer assembly 20, an upward force on packer assembly 30 and a compression on slip assembly 70. These forces, coupled with the weight of the first and second lengths of production tubing 44, 46, expand packer elements 26, 36, and raise slips 72 and housing 74 into contact with tapered end 35 of cone 33, wherein cone 33 secures engaged slips 72 against the inside surface of well casing 40 as shown in FIG. 2, where slips 72 grip the casing wall.

Once the well is returned to producing status, liquids such as oil are brought to the wellhead via bore 17 of internal tube 16 with the aid of down-hole pumps, if necessary. Using gas vent apparatus 10 to repair damaged casing provides a channel for gas to escape to the wellhead without interfering with the operation of any down-hole equipment such as pumps. In the prior art, placement of swab rubber patches or packer assemblies without gas vents cuts off the free flow of gas to the surface of the well. When using the method and apparatus of the invention, however, gas continues its path through casing bore 42 to the surface through the packer assembly 10 via gas ports 28, 38 and annulus 15.

Referring now to FIG. 3, a cross-sectional view of the expanded packer elements 36 of packer assembly 30, taken along line 3—3 of FIG. 2, is shown. When gas vent packer assembly 10 is mechanically set into position, packer elements 36 expand between packer sleeve 62 and well casing 40. Similarly, as shown in FIG. 2, packer elements 26 expand between packer sleeve 52 and well casing 40. Together, expanded packer elements 26, 36 isolate the interval of casing 40 having rupture 50 from the remainder of casing 40 and casing bore 42, thereby preventing the flow of undesired fluids into annulus 15 and bore 17 of internal tube 16. In addition, if subsequent repairs are needed or the well reaches its economic limit, the gas vent packer apparatus of the invention may be retrieved from the well using methods known to one skilled in the art.

As disclosed herein, the preferred embodiments of the invention permit a cost effective repair of damaged casing of marginal wells, providing the additional advantages of a positive mechanical set of the packer assemblies and venting of gas through the packer assemblies to the surface without the problem of gas locking down-hole pumps. While the invention has been described herein relative to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A gas vent packer well casing repair apparatus, comprising:

a first packer assembly having a vent cone and a packer element mounted on a mandrel;

a second packer assembly having a vent cone and a packer element mounted on a mandrel;

a central tube assembly having an upper end, a lower end, and a first tube centrally disposed around a second tube defining an annulus between said first and second tubes; and a slip assembly having a plurality of retractable slips;

wherein said tube assembly is connected between said first and second packer assemblies and said slip assembly is mounted on the mandrel of said second packer assembly adjacent to said cone.

2. The apparatus of claim 1, wherein said first and second packer assemblies have a plurality of packer elements.

3. The apparatus of claim 1, wherein said cone on said second packer assembly secures said slips against a surface when said slips are in the engaged position.

4. The apparatus of claim 3, wherein said surface is the casing of a well.

5. The apparatus of claim 1, wherein each said cone on said first and second packer assemblies has a plurality of gas vent ports.

6. The apparatus of claim 1, wherein said upper end of said tube assembly is connected to said mandrel of said first packer assembly adjacent to said packer element, and said lower end of said tube assembly is connected to the mandrel of said second packer assembly adjacent to said packer element.

7. The apparatus of claim 6, wherein said tube assembly and said first and second packer assemblies comprise a channel for venting gas.

8. A system for repairing a damaged casing in an oil and gas well, said casing having a damaged portion between the lower bottom surface and upper surface opening of a well bore, comprising:

a first and second packer assembly, each packer assembly having a vent cone and a packer element mounted on a mandrel;

a slip assembly;

a central tube assembly having an upper end, a lower end, and a first tube centrally disposed around a second tube defining an annulus between said first and second tubes; and an upper and a lower string of production tubing;

wherein said upper and lower ends of said central tube assembly are connected to the mandrels of said first and second packer assemblies adjacent to said packer elements, said slip assembly is mounted on the mandrel of said second packer assembly adjacent to said vent cone, and said upper and lower strings of production tubing are connected to the mandrels of said first and second packer assemblies adjacent to said vent cone on said first packer assembly and said slip assembly on said second packer assembly.

9. The system of claim 8, wherein said strings of production tubing, packer assemblies, central tubing and slip assembly are mechanically set within the well bore, wherein said slip assembly and second packer assembly engage said casing below said damaged portion and said first packer assembly engages said casing above said damaged portion creating a seal over said damaged portion.

10. A method for repairing a damaged casing of a well, said casing within a well bore between the lower well bottom and upper surface opening, comprising the steps of:

locating a damaged portion of said well casing;

mounting a slip assembly to a first end of a lower packer assembly having first and second ends and a vent cone adjacent to said first end;

attaching a first end of a central tube assembly to said second end of said lower packer assembly, wherein said tube assembly comprises a first tube centrally disposed around a second tube defining an annulus between said first and second tubes;

attaching a second end of the tube assembly to a first end of an upper packer assembly having first and second ends and a vent cone adjacent to said second end;

connecting a first length of production tubing to said slip assembly and lower packer assembly;

connecting a second length of production tubing to said upper packer assembly;

inserting said first production tubing, lower packer assembly, central tube assembly, upper packer assembly, and second production tubing inside said casing of said well;

positioning said central tube assembly over the damaged section of said pipe well casing; and mechanically setting said slip assembly and said upper and lower packer assemblies to create a seal over said damaged section of said casing.

11. The method of claim 10, further comprising the step of venting gas through said vent cone and said annulus between the first and second tubes of said tube assembly.

12. The method of claim 10, further comprising the step of retrieving said first and second production tubing, upper and lower packer assemblies and central tube assembly from said well.

* * * * *